US007000605B2

(12) United States Patent
Due

(10) Patent No.: US 7,000,605 B2
(45) Date of Patent: Feb. 21, 2006

(54) ENGRAVER APPARATUS AND METHOD

(76) Inventor: Joseph E. Due, 840 Grove St., Mauston, WI (US) 53948

( * ) Notice: Subject to any disclaimer, the term of this patent is extended or adjusted under 35 U.S.C. 154(b) by 3 days.

(21) Appl. No.: 10/761,133

(22) Filed: Jan. 20, 2004

(65) Prior Publication Data

US 2005/0155592 A1 Jul. 21, 2005

(51) Int. Cl.

| | |
|---|---|
| ***B24D 1/04*** | (2006.01) |
| ***B24D 5/04*** | (2006.01) |
| ***B24B 55/04*** | (2006.01) |
| ***B24B 55/06*** | (2006.01) |

(52) U.S. Cl. ..... 125/13.01; 125/13.03; 125/38; 451/451; 451/453; 451/456; 451/350; 451/352; 451/358; 451/434; 83/928; 299/36.1; 299/39.1; 299/39.3; 144/1.1; 144/2.1; 144/3.1; 144/4.1; 144/34.1; 144/24.12; 30/170

(58) Field of Classification Search ..... 125/13.01, 125/13.03, 38; 451/451, 453, 456, 350, 352, 451/358, 434; 83/928; 299/36.1, 39.1, 39.3; 144/4.1, 34.1, 24.12, 2.1, 3.1, 1.1; 30/170
See application file for complete search history.

(56) References Cited

U.S. PATENT DOCUMENTS

| | | | | |
|---|---|---|---|---|
| 4,545,121 | A * | 10/1985 | Armbruster et al. | 30/374 |
| 4,676,557 | A * | 6/1987 | Shope et al. | 299/39.3 |
| 4,840,431 | A * | 6/1989 | Jedick | 299/39.3 |
| 5,056,499 | A * | 10/1991 | Chiuminatta et al. | 125/14 |
| 5,074,044 | A * | 12/1991 | Duncan et al. | 30/124 |
| 5,215,071 | A * | 6/1993 | Mertes et al. | 125/13.01 |
| 5,429,420 | A * | 7/1995 | Johnson | 299/39.3 |
| 5,579,753 | A * | 12/1996 | Chiuminatta et al. | 125/12 |
| 5,669,371 | A * | 9/1997 | Rupprecht et al. | 125/13.01 |
| 5,908,224 | A * | 6/1999 | Santos | 299/39.2 |
| 6,019,433 | A * | 2/2000 | Allen | 299/39.3 |
| 6,047,693 | A * | 4/2000 | Yamami et al. | 125/13.01 |
| 6,112,736 | A * | 9/2000 | Bearden | 125/13.01 |
| 6,318,352 | B1 * | 11/2001 | Gnazzo et al. | 125/12 |
| 6,349,712 | B1 * | 2/2002 | Halstead | 125/12 |
| 6,478,666 | B1 * | 11/2002 | Berger et al. | 451/344 |
| 6,623,342 | B1 * | 9/2003 | McDonald | 451/360 |
| 2001/0003983 | A1 * | 6/2001 | Iida et al. | 125/13.01 |
| 2002/0106619 | A1 * | 8/2002 | Farenholtz et al. | 434/262 |
| 2003/0127904 | A1 * | 7/2003 | Due | 299/18 |

* cited by examiner

*Primary Examiner*—George Nguyen
*Assistant Examiner*—Bryan R. Muller
(74) *Attorney, Agent, or Firm*—Merchant & Gould P.C.

(57) ABSTRACT

A concrete engraver apparatus including a carrier for use with a hand-held engraver. The hand-held engraver is detachably mounted to the carrier. The carrier has wheels and a handle attached to an enclosure. The enclosure includes a vacuum mount for attaching a vacuum tube to evacuate loosened particles from the enclosure during operation of the hand-held engraver.

24 Claims, 4 Drawing Sheets

ENGRAVER APPARATUS AND METHOD

TECHNICAL FIELD

The principles disclosed relate to the operation and use of a concrete engraver. More particularly, this disclosure concerns a hand-held concrete engraver that is detachably mountable to a carrier.

BACKGROUND

Engravers are used to repair and replace cracked concrete. In some applications, larger engraver machines are used to prepare expansion joints that replace the cracked concrete section. In preparation of an expansion joint, large sections of concrete are removed by cutting straight lines in the concrete, removing the section, and replacing the section by pouring an entirely new section. Excessive material and labor costs are incurred with such methods because an entire section defined by straight line cuts must be replaced.

In other applications, hand-held engravers are used to repair the cracked concrete without replacement of a large section. In such applications, the hand-held engraver follows a crack in the concrete to clean out the crack in preparation for a filling material. Because the hand-held engravers are small in size, operation of the engraver is not constrained to providing only a straight line, as with the larger engraver machines. By following the crack, only the damaged concrete need be cleaned up and repaired.

Use of hand-held engravers, however, can be significantly laborious as the operator is required to be on his hand and knees during operation of the engraver. This type of work is tiring and sometimes causes back, knee, or other injury to the operator. In addition, hand-held engravers are typically pushed along the concrete crack. Pushing the hand-held engraver in the direction of the cut makes visibility difficult, as the concrete particles and dust are directed forward along the crack and cover the crack path that the operator is trying to follow.

In general, improvement has been sought with respect to concrete engraver devices, generally to accommodate ease of use and improve concrete repair and replacement methods.

SUMMARY

One aspect of the present invention relates to a concrete engraver detachably mounted to a carrier. Another aspect of the present invention relates to a method for engraving concrete that preferably includes a concrete engraver detachably mounted to a carrier.

DETAILED DESCRIPTION

With reference now to the various figures in which identical elements are numbered identically throughout, a description of various exemplary aspects of the present invention will now be provided.

Figure 1:
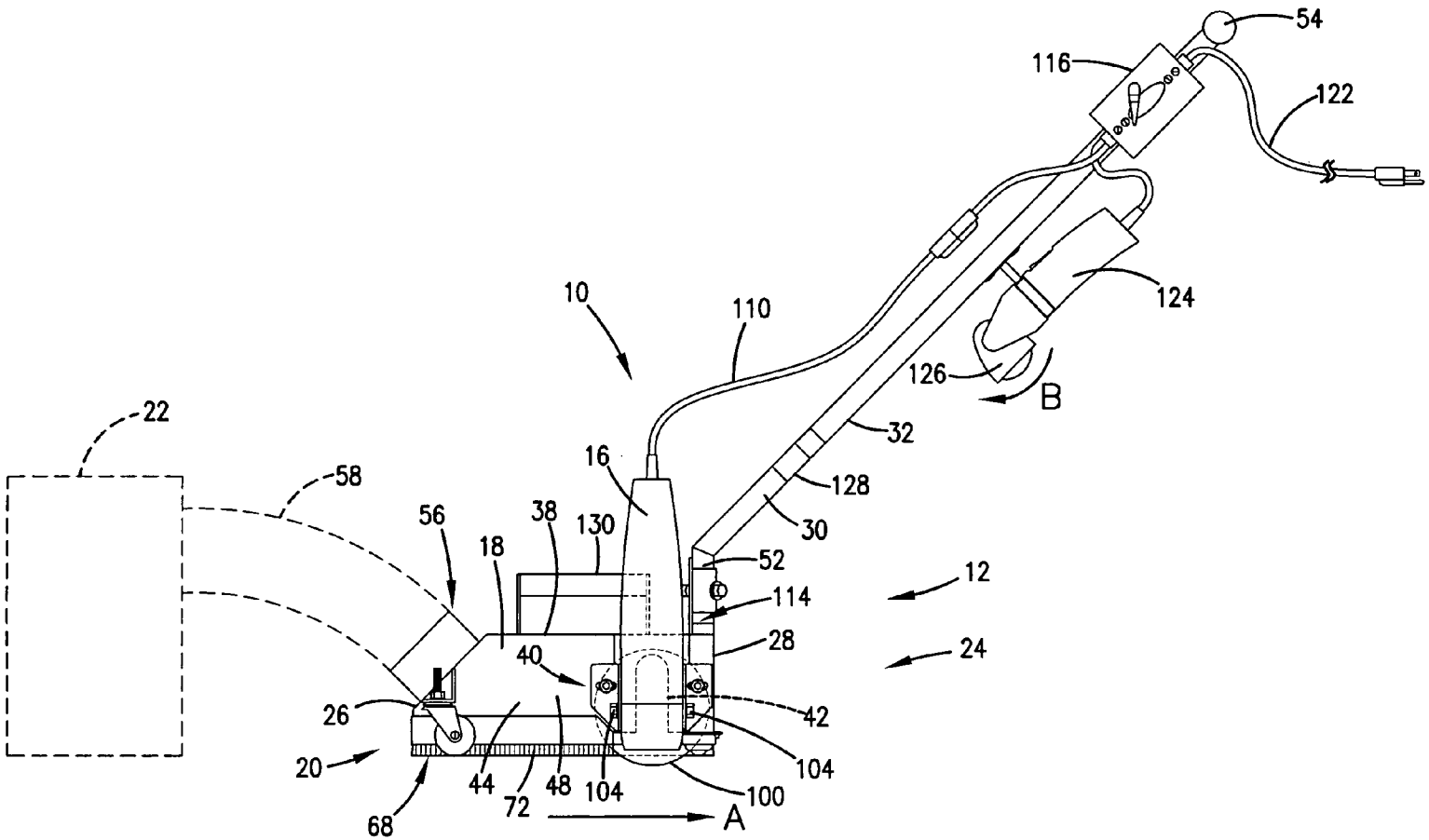
FIG. 1 is a side elevational view of one embodiment of an engraver apparatus according to the principles of the present invention.

FIG. 1 illustrates an engraver apparatus 10 that is an embodiment of the present invention. In general, the engraver apparatus 10 includes a carrier 12 (i.e., a carriage, dolly, cart) and an engraver 16. In use, the carrier 12 of the engraver apparatus 10 is pulled (in a direction represented by arrow A) along a concrete crack while the engraver 16 rotates to provide a cut in the concrete working surface. Because the engraver apparatus 10 is pulled, for purposes of clarification, the front of the engraver apparatus refers to the portion of the apparatus closest to the operator as the apparatus is being pulled, and the rear of the engraver apparatus refers to the portion of the apparatus farthest from the operator.

Figure 5:
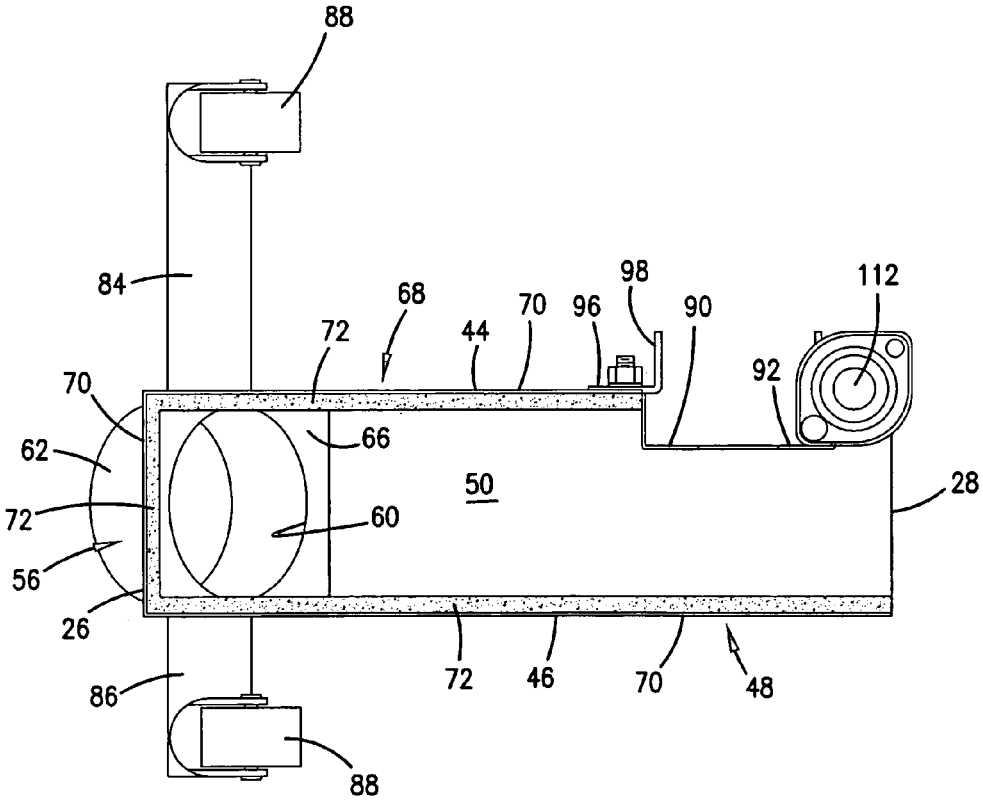
FIG. 5 is bottom plan view of the housing of FIG. 4.

The carrier 12 shown in FIG. 1 includes a main body 18 having a rear region 20 and a front region 24. The main body 18 has a rear wall 26, a front wall 28, a top wall 38, and opposing first and second sidewalls 44, 46 (FIG. 5). The rear wall, front wall, top wall and sidewalls define an enclosure 48 having an interior 50 (FIG. 5). In one non-limiting embodiment, the main body 18 is constructed of plate steel welded together to define the enclosure 48.

Figure 2:
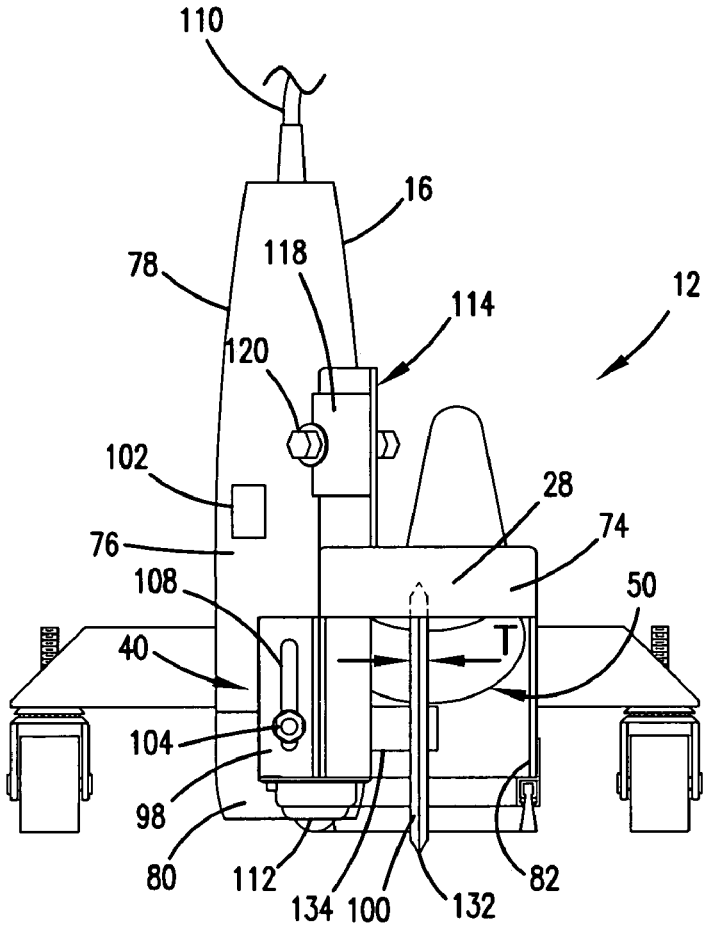
FIG. 2 is a front elevational view of one embodiment of a housing of the engraver apparatus, shown in FIG. 1.

Referring now to FIGS. 1 and 2, the engraver 16 is detachably mounted to the front region 24 of the carrier 12. The engraver 16 may include, for example, hand-held concrete engravers or grinders commonly found within the industry. What is meant by hand-held is that the engraver device is capable of operating apart and separate from the carrier 12. Suitable engravers are sold by Metabo Inc., of Germany.

The engraver 16 has an interchangeable grinding or engraving disc 100. In the illustrated embodiment, the engraver 16 is generally vertically mounted to the carrier 12 such that an outer edge 132 of the disc 100 creates a narrow cut in the working surface. As can be understood, the narrow cut provided the engraver 16 generally corresponds to the thickness T of the disc 100. That is, the cut in the working surface is less than a cut provided by a surface area (defined by the disc diameter) of the disc, for example. In an alternative embodiment, the housing of the engraver 16 may be oriented at an angle while still maintaining the vertical orientation of the disc 100. In another embodiment, the engraver 16 and disc 100 may be tilted such that the disc 100 is angularly oriented relative to a vertical orientation to provide a narrow cut. Typically, the disc 100 is oriented vertically as shown in FIG. 2.

In one embodiment, the hand-held engraver 16 generally includes a housing 76 (FIG. 2) having a handle 78, an electric motor (not shown) located within the housing 76, and a rotary head 80 having an shaft 134. The interchangeable disc 100 couples to the shaft 134. The hand-held engravers typically include an operating switch 102 (schematically shown in FIG. 2) and a power cord 110. Other hand-held configurations that can be detachably mounted to the carrier 12 may be used in accordance with the principles herein disclosed. The carrier 12 may also be used with power pack engravers that run on a battery pack (not shown). While it is preferred to detachably mount engravers to the carrier, permanently mounted configurations can also be used.

Figure 4:
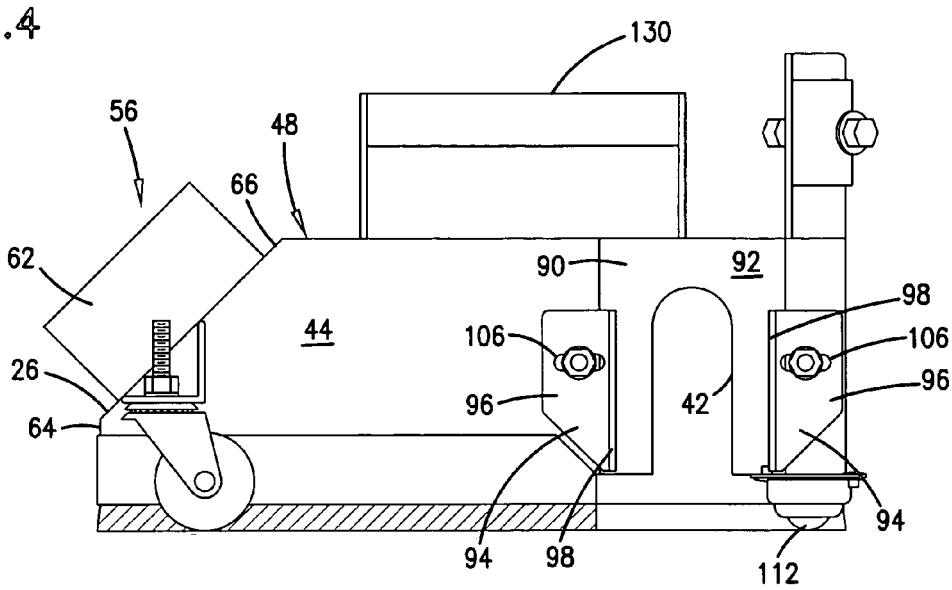
FIG. 4 is a side elevational view of the housing of FIG. 2, shown without a hand-held engraver.

Referring now to FIGS. 4 and 5, a recess 90 is formed in the first sidewall 44 of the enclosure 48. The recess 90 has a recess surface 92 that extends generally parallel to the first sidewall 44 of the enclosure. A slot 42 is formed in the recess surface 92. As shown in FIG. 2, the slot 42 provides clearance for the rotary head 80 of the engraver 16 so that the disc 100 can be positioned within the interior 50 of the enclosure 48 of the carrier 12. Brackets 94 are attached to the first sidewall 44 adjacent to the recess 90. In the illustrated embodiment, the brackets 94 are L-brackets having a first bracket portion 96 and a second bracket portion 98. A first slot 106 is formed in the first bracket portion 96; and a second slot 108 (FIG. 2, only one shown) is formed in the second bracket portion 98.

The brackets 94 are designed to accommodate a variety of engraver configurations. The first slots 106 are horizontally oriented to permit each of the brackets 94 to be moved away from or toward one another to accommodate varying widths of different engraver housings 76. Likewise, the second slots 108 are vertically oriented to accommodate varying lengths of different engraver housings. In addition, the second slot 108 accommodates varying disc sizes. For example, an operator may interchange a 5-inch disc with a 7-inch disc, depending upon the application. The second slot 108 of the bracket 94 permits the operator to locate either of the 5-inch or 7-inch disc at the same height relative to the work surface by raising or lowering the engraver 16 within the second vertical slot 108.

Referring back to FIGS. 1 and 2, the illustrated hand-held engraver 16 is mounted to the carrier 12 at the recess 90 (FIGS. 4 and 5) formed in the main body 18 of the carrier 12. In particular, the engraver 16 is detachably mounted to the brackets 94 (FIG. 4) by fasteners 104 such as bolts, for example. The fasteners 104 and second slots 108 of the brackets 94 define an adjustable mounting arrangement 40 configured to mount the engraver 16 at one of a plurality of heights relative to the working surface. By providing an adjustable mounting arrangement 40, the operator may re-adjust the mounting height of the engraver 16 to either accommodate disc wear, or accommodate interchanging disc 100 sizes as needed.

Figure 3:
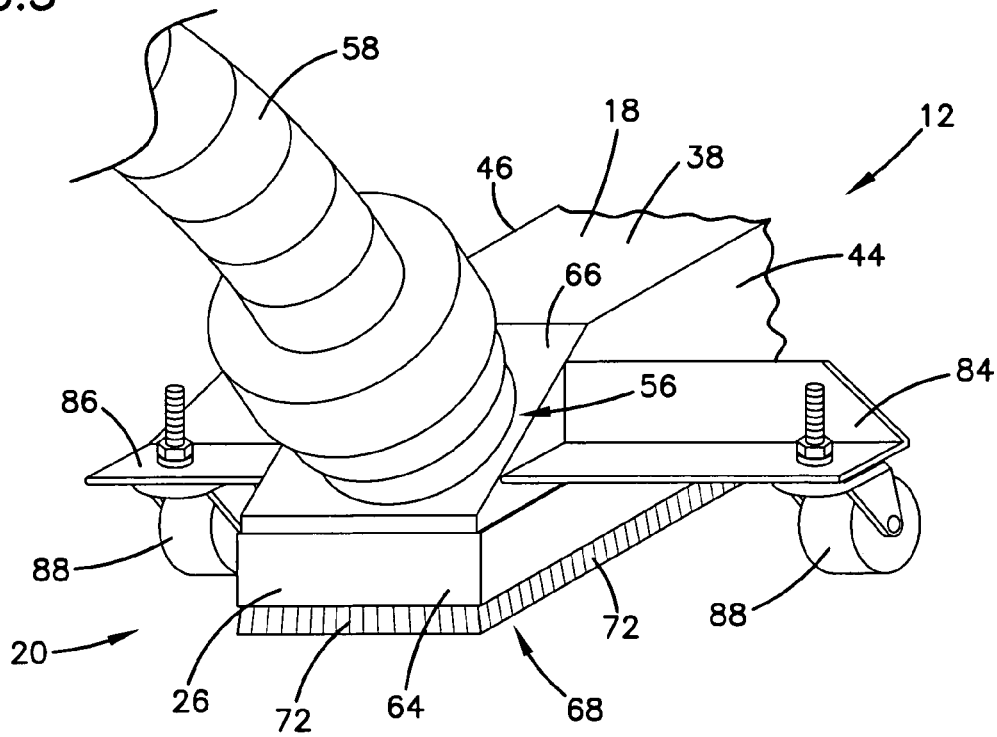
FIG. 3 is a rear perspective view of the housing of FIG. 2, shown with a vacuum tube attached.

Referring now to FIGS. 3 and 5, the rear region 20 of the carrier 12 includes first and second extension members 84, 86 connected or welded to the main body 18 of the carrier 12. While any number of different configurations could be used, the extension members 84, 86 of the illustrated embodiment are L-brackets. The first extension member 84 projects outwardly from the first sidewall 44 and the second extension member 86 projects outwardly from the second sidewall 46. Wheels 88 are attached to each of the first and second extension members 84, 86. The wheels 88 permit the carrier to roll along the work surface during transport and operation. The wheels 88 may include swivel casters, as shown. Other types of wheels, such as non-swiveling casters or wheels or even members adapted to slide across the floor (e.g., a plastic wear-resistant slide member) rather than roll may be used.

In the illustrated embodiment of FIG. 5, the first extension member 84 is longer than the second extension member 86. This is to provide leverage for the load carried on that particular side (i.e., the first sidewall 44) of the carrier 12. In particular, the length of the first extension member 84 counters the weight of the hand-held engraver 16 when mounted at first sidewall 44 of the carrier 12. The longer first extension member 84 thereby stabilizes and balances the engraver apparatus 10 during operation and transport.

Referring now to FIGS. 3 and 4, the rear wall 26 of the enclosure 48 has a first rear wall section 64 joined to a second angled wall section 66. The angled wall section 66 defines an aperture or exhaust port 60 (FIG. 5) that extends into the interior 50 of the enclosure 48. Attachment structure 56 is positioned adjacent to the exhaust port 60. The attachment structure 56 is used to connect a collection hose or vacuum tube 58 (FIG. 3) of a vacuum (shown schematically as 22 in FIG. 1). In the illustrated embodiment, the attachment structure 56 is a collar 62 positioned about the perimeter of the exhaust port 60. The vacuum tube 58 of the vacuum 22 may be attached to the collar 62 by a clamping device, an interference slip fit, latches or brackets, or any other device that secures the vacuum tube 58 in flow communication with the exhaust port 60 of the carrier 12.

The vacuum 22 may be any type of collection device or vacuum known to those of skill in the art that is adapted to generate suction sufficient to evacuate particles, such as concrete pieces and concrete dust, from the interior 50 of the enclosure 48. For example, the vacuum 22 may be a stand-alone shop type vacuum having a separate power cord. In some applications, the separate power cord is attached to a power source or outlet located at the work site. In other applications, the vacuum 22 can be electrically plugged into or interconnected to an electrical switch box 116 (FIG. 1) located on the carrier 12. As will be discussed in greater detail, the electrical switch box 116 has a power cord 122 that plugs into an electrical source (not shown) at the work site for operation of the engraver apparatus 10.

Referring to FIG. 1, providing the attachment structure 56 on the angled wall section 66 of the rear wall 26 positions the evacuation tube 58 of the vacuum 22 so as to not interfere with operation of the engraver apparatus 10. That is, the vacuum 22 and tube 58 can be pulled behind the apparatus 10 as the apparatus 10 is pulled along a concrete crack. In alternative embodiments, the attachment structure 56 may be located on the top wall 38 or sidewalls 44, 46 of the enclosure 48. For example, each of the sidewalls 44, 46 may include a closable vacuum tube attachment structure so that an operator can change attachment locations of the vacuum tube 58 when working closely against walls or other obstacles.

Referring now to FIGS. 1, 3 and 5, a particle or dust containment arrangement 68 is located along a majority of a perimeter edge 70 of the main body 18. The perimeter edge 70 of the main body 18 is defined by edges of the sidewalls 44, 46 and the rear wall 26. The dust containment arrangement 68 provides a seal or barrier to contain particles within the enclosure 48 during operation of the engraver 16. In the illustrated embodiment, the dust containment arrangement 68 includes brushes 72 fastened to the first and second sidewalls 44, 46 and the first section 64 of the rear wall 26. The brushes 72 preferably ride along the working surface to contain concrete dust and particles within the interior 50 of the enclosure 48 so that the vacuum 22 can collect the debris; also, the brushes act to sweep the working surface and direct dust into the interior 50 of the enclosure for evacuation of the debris while the carrier 12 is being pulled along the working surface.

Referring back to FIG. 1, a handle shaft 30 is coupled to the main body 18 of the carrier 12 at the front region 24 of the main body 18. The handle shaft 30 has an extension section 32 connected to a bent or angled section 52. In the illustrated embodiment, the handle shaft 30 is detachably secured to the main body 18 of the carrier 12 at a handle mount 114. As shown in FIG. 2, the handle mount 114 is welded to the main body 18 at the front region 24 of the body 18. The angled section 52 of the handle shaft 30 is secured to the handle mount 114 of the main body 18 by a clamp bracket 118 and bolt 120. Referring again to FIG. 1, handles 54 (only one shown) extend outward from the extension section 32 of the handle shaft 30. The handles 54 may include grips (not shown) to assist in handling the carrier. In one embodiment, the length of the handle shaft 30 may be adjustable. That is, the length of the handle shaft 30 can be adjusted by raising or lowering a sliding adjustment section (not shown) of the extension section 32 to a desired position.

Referring again to FIG. 2, the front wall 28 of the enclosure 48 is a partial front wall 74 that defines an opening 82 at the front region 24 of the carrier 12. The opening 82 provides physical and visual access to the interior 50 of the enclosure 48, as will be described in greater detail hereinafter.

Referring to FIG. 4, a roller or ball wheel 112 is also located at front region 24 of the main body 18 of the carrier 12. The ball wheel 112 functions as a stop to limit the engraving depth of the engraver apparatus 10. In particular, the engraving depth of the apparatus 10 is adjustable via the adjustable mounting arrangement 40 (e.g., by positioning the hand-held engraver 16 at various positions within the second slot 108 of the engraver mounting brackets 94). That is, an engraver 16 having a particular disc size can be positioned at a first position within the second slots 108 to provide a first engraving depth within the working surface, or lowered or raised within the second slot to a second position to provide a second different engraving depth. The ball wheel 112 acts a stop to limit the overall engraving depth in correspondence to the slot position and disc size of the engraver 16.

For example, if the engraver 16 is positioned at the first position, the maximum engraving depth is determined by the distance between the outer edge 132 of the engraver disc 100 and the ball wheel 112. If the engraver 16 is position at a second lower position, the maximum engraving depth is greater than at the previous first position as the distance between the outer edge 132 of the engraver disc 100 and the ball wheel 112 is greater. Similarly, the overall engraving depth can be changed by changing the disc size. Accordingly, the maximum engraving depth depends upon the size of the engraver disc 100 and the position of the engraver 16 within the second slot 108 of the bracket 94. Thereby, the stop depth provided by the ball wheel 112 is adjustable by adjusting the position of the engraver 16 or changing the size of the engraver disc 100.

In use, an operator will select the size of engraver disc 100 required for the particular application. The size of disc needed typically depends upon the concrete type or material, and desired engraving depth, width, etc. The disc 100 is attached to the rotary head 80 of the hand-held engraver 16, and the engraver is then mounted to the carrier 12. The engraver 16 is selectively positioned with the vertical slots 108 of the mounting brackets 94 and may be adjusted as needed. The power cord 110 of the engraver 16 is electrically coupled to the switch box 116 of the carrier 12. The power cord 122 of the switch box 116 is then plugged into a power source at the work site.

The vacuum tube 58 of the vacuum 22 is coupled to the exhaust port 60 of the carrier 12. That is, the vacuum tube 58 is attached to the collar 62 of the attachment structure 56 of the engraver apparatus 10. As previously described, the vacuum 22 may be electrically connected to the switch box 116 or connected to a separate power source (not shown).

Referring to FIG. 1, the engraver apparatus also includes a light 124. The illustrated light 124 has a pivoting head 126 that can be rotated in the direction represented by arrow B to illuminate various sections of the working surface. In one preferred embodiment, the light 124 includes a Halogen light bulb to better withstand vibrations experienced during operation than other types of light bulbs.

The light 124 is electrically connected to the switch box 116. The switch box 116 of the engraver apparatus 10 provides an arrangement whereby the cords of, for example, the vacuum 22, light 124, and hand-held engraver 16 are electrically connected in one location. The cords can be neatly wrapped around cord hangers (e.g. 128) so that an operator need only maneuver one power cord, i.e. the power cord 122, during operation of the engraver apparatus 10. Also, the switch box 116 permits the operator to control electrical power to each of the components (e.g., the hand-held engraver 16, light 124, and vacuum 22) of the engraver apparatus 10. This is advantageous in providing a single switch control during intermittent use or operation of the engraver apparatus.

The engraver apparatus 10 is designed such that the carrier 12 and engraver 16 can follow the path of a concrete crack rather than provide only a straight line cut. In particular, with the engraver 16 powered on, an operator grasps the handles 54 of the carrier 12 and pulls the engraver apparatus 10 in the direction of arrow A shown in FIG. 1. Because of the size of the hand-held engraver 16, and the swiveling wheels 88 of the carrier, the operator can follow cracks that jag off in sporadic directions; thereby eliminating the need to replace large sections of the working surface.

When pulling the engraver apparatus 10 during operation, the opening 82 of the partial front wall 74 of the carrier 12 provides physical and visual access to the interior 50 of the enclosure 48. The operator can view the interior 50 of the enclosure 48 to monitor operation of the engraver 16 and, for example, wear of the engraver disc 100. In addition, the opening 82 permits an operator to view the working surface during operation of the engraver apparatus 10 so that the operator can turn the apparatus 10 and more closely follow the varying directions of the concrete crack path. The head 126 of the light 124 may be pivoted to better illuminate the opening 82 and region adjacent to the disc 100 for viewing.

As can be understood, in the preferred embodiment, the disc 100 of the engraver 16 rotates in a clockwise direction as view from FIG. 1. This directs the concrete dust and particular toward the rear region 20 of the enclosure 48 and toward the exhaust port 60. The dust and concrete particles loosened and removed from a concrete working surface during operation of the engraver apparatus 10 are then suctioned through the exhaust port 60 of the enclosure 48 by the vacuum 22 to provide a cleaner working surface and work site.

As shown in FIGS. 1 and 4, a carrying handle 130 is attached to the top wall 38 of the main body 18 of the carrier 12. The carrying handle 130 can be used to carry or transport the engraver apparatus 10 from location to location.

In addition to repairing concrete, the disclosed engraver apparatus 10 can also be used to provide decorative cuttings in concrete surfaces. For example, artistic designs in working surfaces, which would normally be very laborious to create, can be created easily with the disclosed engraver apparatus.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An engraver apparatus comprising:

a) a carrier including a main body defining an enclosure, a vacuum mount in communication with the enclosure, and at least one wheel;

b) a hand-held engraver mounted to the carrier, the hand-held engraver including a housing and a rotary head interconnected to the housing, at least the rotary head being located within an interior of the enclosure, the hand-held engraver being oriented to provide a narrow cut in a working surface wherein the hand-held engraver is removable from the carrier as a separate, operable unit; and c) a handle attached to the main body of the carrier.

2. The engraver apparatus of claim 1, wherein the housing of the hand-held engraver being an elongated housing having a handle portion.

3. The engraver apparatus of claim 2, wherein the hand-held engraver further includes an operating switch electrically connected to a power cord.

4. The engraver apparatus of claim 1, further including a mounting arrangement that detachably mounts the hand-held engraver to the carrier.

5. The engraver apparatus of claim 4, wherein the mounting arrangement is adjustable, the hand-held engraver being mountable to the carrier in a plurality of positions relative to the working surface.

6. The engraver apparatus of claim 5, wherein the adjustable mounting arrangement includes brackets having vertical slots to mount the hand-held engraver at various heights relative to the working surface.

7. The engraver apparatus of claim 5, wherein the adjustable mounting arrangement is also configured to accept varying sizes of hand-held engravers.

8. The engraver apparatus of claim 7, wherein the adjustable mounting arrangement includes first and second brackets, each of the first and second brackets having a horizontal slot to vary the distance between the first and second brackets to accept varying sizes of hand-held engravers.

9. The engraver apparatus of claim 1, further including a vacuum having a collection tube connected to the vacuum mount of the carrier, the vacuum mount and collection tube providing flow communication between the vacuum and the interior of the enclosure for evacuation of particles loosened by the engraver.

10. The engraver apparatus of claim 1, wherein the carrier further includes a particle containment arrangement that contains particles loosened by the engraver within the enclosure.

11. The engraver apparatus of claim 10, wherein the particle containment arrangement includes brushes located along a majority of a bottom perimeter of the enclosure.

12. The engraver apparatus of claim 1, wherein the main body has a rear region and a front region, the main body further including an opening at the front region to monitor operation of the engraver apparatus.

13. The engraver apparatus of claim 12, further including a light positioned to illuminate the area adjacent to the opening at the front region to assist in monitoring operation of the engraver apparatus.

14. The engraver apparatus of claim 1, further including a stop positioned on the carrier that limits a depth of engraving provided by the hand-held engraver.

15. The engraver apparatus of claim 1, wherein the main body of the carrier includes a recess sized for receipt of the hand-held engraver.

16. The engraver apparatus of claim 1, wherein the main body defining the enclosure includes a slot extending from an exterior to the interior of the enclosure.

17. The engraver apparatus of claim 16, wherein the hand-held engraver is mounted at the slot such that the rotary head of the hand-held engraver is positioned within the interior of the enclosure and the housing of the hand-held engraver is positioned at exterior of the enclosure.

18. The engraver apparatus of claim 16, wherein the slot is located in a recess formed in the main body of the carrier.

19. The engraver apparatus of claim 1, wherein the carrier includes two wheels positioned adjacent a first end of the carrier, each of the two wheels extending outward from opposite sides of the carrier.

20. The engraver apparatus of claim 19, wherein one of the two wheels extends a distance farther from the respective side of the carrier than the other wheel.

21. The engraver apparatus of claim 19, further including a ball wheel positioned adjacent to a second end of the carrier.

22. The engraver apparatus of claim 21, wherein the ball wheel positioned adjacent to the second end and the two wheels positioned adjacent to the first end of the carrier are arranged in a triangular configuration.

23. A method of engraving a concrete working surface, the method comprising:

a) providing an engraver apparatus, the engraver apparatus including:

i) a carrier having a main body defining an enclosure, a handle extending from the main body and a vacuum mount;

ii) a separate, operable hand-held engraver; and iii) a vacuum having a vacuum tube:

b) attaching the vacuum tube to the vacuum mount of the carrier;

c) mounting the hand-held engraver to the main body of the carrier;

d) operating the hand-held engraver;

e) evacuating particles loosened by the hand-held engraver by the operation of the vacuum; and f) removing the hand-held engraver from the carrier for use as a separate, operable engraver unit.

24. The method of claim 23, wherein the step of mounting the hand-held engraver includes mounting the hand-held engraver such that a rotary head of the engraver is located within the enclosure defined by the main body of the carrier.

* * * * *